United States Patent [19]

Tölle et al.

[11] Patent Number: 5,026,103

[45] Date of Patent: Jun. 25, 1991

[54] SPRING SUPPORT FOR A MOTOR VEHICLE DOOR FASTENER

[75] Inventors: Karl-Heinz Tölle, Wuppertal; Willi Steckel, Remscheid, both of Fed. Rep. of Germany

[73] Assignee: Ed. Scharwächter GmbH & Co. KG, Remscheid, Fed. Rep. of Germany

[21] Appl. No.: 473,612

[22] Filed: Feb. 1, 1990

[30] Foreign Application Priority Data

Feb. 1, 1989 [DE] Fed. Rep. of Germany ..... 3902879

[51] Int. Cl.[5] ..... E05C 17/18

[52] U.S. Cl. ..... 292/275; 16/86 C; 292/DIG. 57

[58] Field of Search ..... 292/275, 77, 262, 278, 292/193, DIG. 57, 272; 16/86 C, 91, DIG. 17; 267/57, 154

[56] References Cited

U.S. PATENT DOCUMENTS

| | | | |
|---|---|---|---|
| 804,228 | 11/1905 | Hunt | 292/193 X |
| 1,105,963 | 8/1914 | Clem | 292/77 |
| 2,476,182 | 7/1949 | Davidson | 16/86 C |
| 2,693,616 | 11/1954 | Cromwell et al. | 292/275 |
| 3,158,908 | 12/1964 | Springer | 292/DIG. 30 |

*Primary Examiner*—Richard E. Moore

*Attorney, Agent, or Firm*—Joren, McGeady & Associates

[57] ABSTRACT

In a door fastener for motor vehicle doors which can be assembled independent of the door hinges and whose door holding bar, which is formed by means of a sheet metal material blank, cooperates with a torsion bar spring supported in a holder housing formed from a folded sheet metal material blank, the shaft of the torsion bar spring is supported at the side walls of the holder housing of a bearing shell which made of a maintenance-free, self-supporting material, bridges the holder housing and is secured at the latter against a movement in the axial and radial directions.

8 Claims, 2 Drawing Sheets

SPRING SUPPORT FOR A MOTOR VEHICLE DOOR FASTENER

BACKGROUND OF THE INVENTION

The invention is directed to a spring support for a motor vehicle door fastener in which a rigid door holding bar, which is hinged so as to be swivelable at a door arrangement part, door or door post and penetrates a holder housing which is rigidly fastened at the other door arrangement part, is acted upon by means of a loading roller which is arranged so as to be freely rotatable on the free loading arm of a torsion bar spring arranged in the holder housing and supported at the latter via a support arm.

In motor vehicle door fasteners of this type, the loading spring, which is required for applying a braking and holding force of the door fastener and is constructed as a torsion spring, comprises an S- or C-shaped curvature and is held and supported inside the holder housing via its shaft part and also via its loading arm in such a way that its free loading arm is deflected during the passage of the catch recesses of the door holding bar through the holder housing. As has been proven in practice, this deflection of the loading arm of the door holder bar also causes a turning of the shaft part of the torsion bar spring relative to the areas of the holder housing supporting it, so that noise results within the door fastener which becomes greater as the length of operation of the door fastener increases and accordingly as the wear of the support of the shaft part of the torsion bar spring increases.

Attempts have been made to circumvent this problem by greasing the shaft part of the door holding bar, but it has been shown that this step is not sufficient for eliminating noise inside the door fastener throughout its entire service life. In addition, in door fasteners which are equipped with a loading spring constructed as a torsion spring and which form a constructional unit with a door hinge formed from hinge sections, it is known to support the shaft part of the torsion spring by means of a bearing shell of maintenance-free bearing material in a corresponding recess of the hinge leaf of one hinge half. The shaft part of the torsion spring and the bearing shell are fixed by means of indentations of the hinge leaf which overlap the shaft part of the torsion spring. However, such a support of the torsion spring is only possible where the shaft part of the torsion spring lies in a recess of the hinge leaf along a sufficient length, so that a certain axial wandering of the bearing shell can be permitted without contact occurring between the shaft part of the torsion spring and the hinge leaf supporting it, which contact leads to noise.

SUMMARY OF THE INVENTION

Accordingly, it is an object of the present invention to provide an improved door fastener, which is also insertable independent of the door hinges, with a torsion spring door fastener equipped with a holder housing which is folded out of a sheet metal material blank of the above-mentioned type so that the fastener also works in a noiseless manner throughout its entire service life at the lowest possible production cost.

Pursuant to this object, and others which will become apparent hereafter, one aspect of the present invention resides in the torsion bar spring being received in an elongated recess of the holder housing, which is folded from a sheet metal material blank. The torsion bar spring is supported, with respect to its shaft part, within the holder housing via a bearing shell of self-supporting and maintenance-free bearing material. The bearing shell is held in its position inside the holder housing by means of a preselected pretensioning between the shaft part and the support arm in addition to the mechanically acting holding means. The bearing shell bridges the intermediate space between the two side walls of the holder housing forming the support of the shaft part of the torsion bar spring and is protected against wandering in the axial direction in addition by means of ears which are set off radially relative to the cross section profile and contact the outer surfaces of the side walls of the holder housing. This arrangement and construction of the bearing shell results in a permanent maintenance-free and frictionless support of the shaft part of the torsion spring which lasts through the entire service life of the door fastener, which support in turn ensures a permanent absence of noise. Starting from the fact that the bearing shell is held within the recess of the side walls of the holder housing substantially by means of the pretensioning between the shaft part and the support arm of the torsion bar spring, the realization of this bearing of the shaft part of the torsion bar spring also requires no special additional production cost for the door fastener.

The bearing shell can be additionally secured with respect to position without additional production costs for the door fastener in that the bearing shell is simultaneously also clawed in the outer surfaces of the side walls of the holder housing via the ears which are set off radially relative to their section cross section, which is made possible in the simplest manner in that the ears comprise a blank which is directed at an acute angle relative to the longitudinal axis of the bearing shell.

According to another preferred embodiment of the invention, the bearing shell comprises at least one projection which is directed radially outward, and the bearing shell is fastened inside the holder housing at its transverse wall so as to be secured against wandering in the circumferential direction as well as in the longitudinal direction by means of the projection.

It lies within the framework of the invention that the radially outwardly directed projection of the bearing shell is formed by means of at least one nipple which is arranged in the center of the bearing shell with reference to its longitudinal extent and with reference to its cross-sectional profile.

In this connection, it can naturally also be provided that the bearing shell is supported so as to be secured against wandering at a transverse wall or at the two side walls of the holder housing via a plurality of radial projections or nipples which are directed radially relative to its cross-sectional profile.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
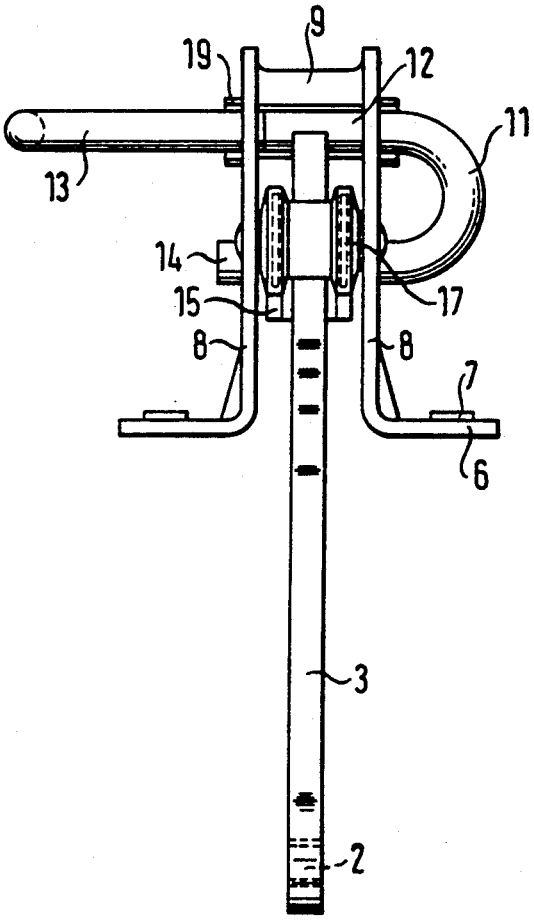
FIG. 1 shows a front view of a door fastener, according to the invention.
Figure 2:
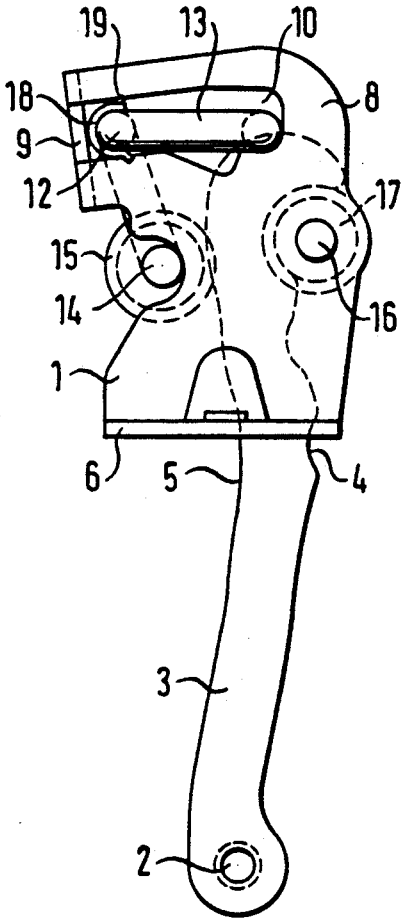
FIG. 2 shows a side view of the door fastener of FIG. 1.
Figure 3:
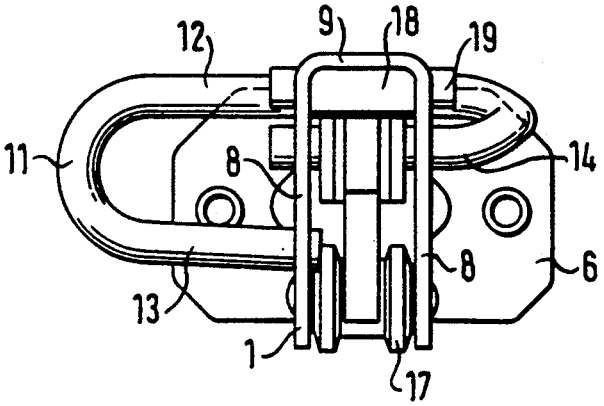
FIG. 3 shows an end view of the door fastener of FIG. 1.
Figure 5:
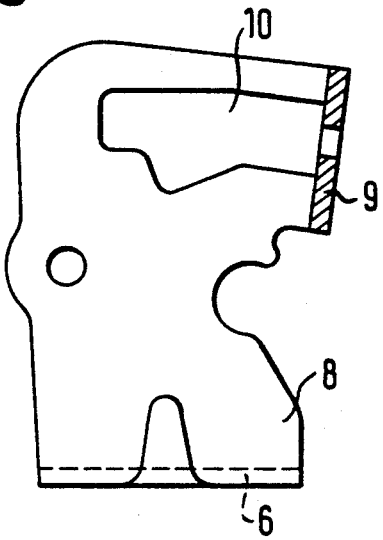
FIG. 5 shows a section through the holder housing according to FIG. 4.
Figure 4:
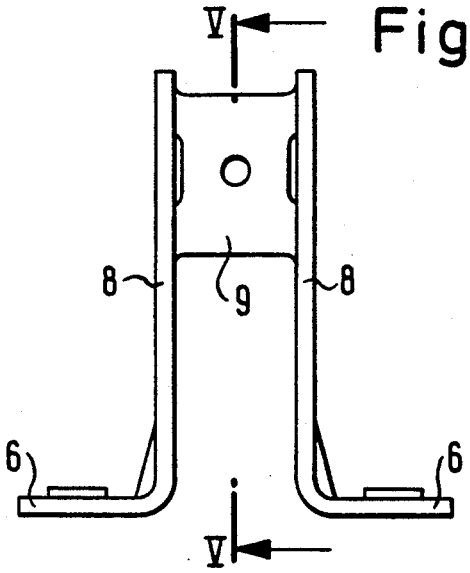
FIG. 4 shows an end view of the holder housing of the door fastener of FIGS. 1–3.
Figure 7:
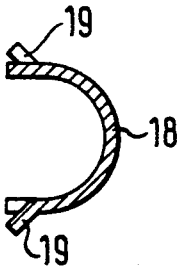
FIG. 7 shows a section through the bearing shell according to FIG. 6.
Figure 6:
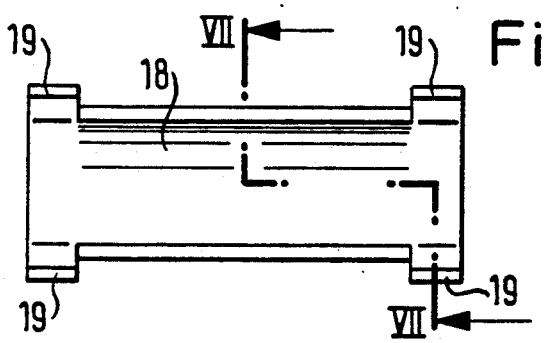
FIG. 6 shows a top view of a bearing shell for a door fastener according to FIG. 1.
Figure 9:
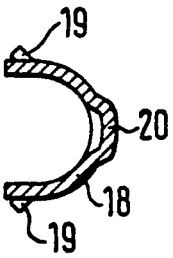
FIG. 9 shows a section through the bearing shell according to FIG. 8.
Figure 8:
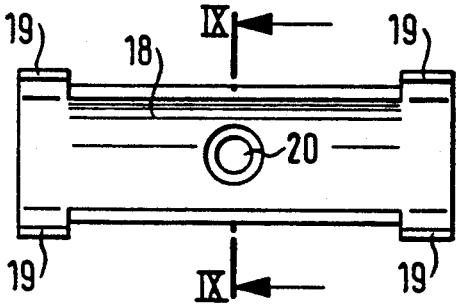
FIG. 8 shows a top view of another embodiment of a bearing shell for a door fastener.
Figure 10:
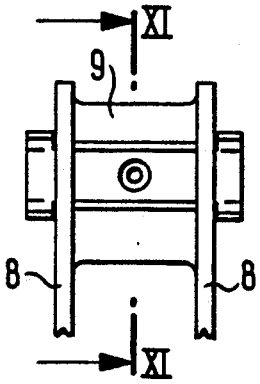
FIG. 10 shows an end view, in section, of a holder housing equipped with a bearing shell according to FIG. 8.
Figure 11:
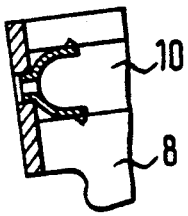
FIG. 11 shows a section through the holder housing according to FIG. 10.

A door fastener, which can be assembled independent from the door hinges of a vehicle door, is shown in FIGS. 1–3 and comprises a holder housing 1 which can be rigidly fastened at a door arrangement part, door or door post, and a door holding bar 3 which penetrates the latter and is fixed at the other door arrangement part so as to be swivelable around an axis 2. The door holding bar 3 is formed by means of a sheet metal material blank and is provided with catch recesses 4 which are arranged so as to lie opposite their rear surface 5.

The holder housing 1 is folded in a substantially U-shaped manner from a sheet metal material blank and is provided with laterally set off foot or fastening flanges 6, by means of which the housing is fixed at the corresponding door arrangement part by means of fastening elements 7. The U-shaped holder housing 1 comprises side walls 8 which are parallel to one another, and a partial transverse wall 9, and is provided, with respect to its side walls 8, with elongated recesses 10 which are penetrated by a torsion bar spring 11.

The torsion bar spring 11 is bent in a substantially S-shaped manner in the illustrated embodiment and lies with its shaft part 12 at one end and with its support arm 13 at the other end of the elongated recess 10. At its free loading arm 14, the torsion bar spring 11 carries a loading roller 15 which cooperates with the back 5 of the door holding bar and presses the door holding bar against an abutment roller 17 which is supported in the holder housing 1 so as to be rotatable around a stationary axis 16. The shaft part 12 of the torsion bar spring 11 is supported in the elongated recesses 10 of the two side walls 8 of the holder housing 1 with the intermediary of a bearing shell 18 which is U-shaped in cross section, the elongated recesses 10 being congruent relative to one another.

The bearing shell 18 is held in its position at least partially by means of the pretension resulting from the predetermined angular position of the shaft part 12 and the support arm 13 of the torsion bar spring 11. The shell 18 comprises a supporting metal, particularly steel, back provided with a TEFLON coating and provided at both ends with ears 19 which are set off radially relative to its cross section so as to contact the outer surfaces of the two side walls 8 of the holder housing 1 and thus secure the bearing shell 18 additionally against wandering in the axial direction. The radially set ears 19 are provided to claw into the outer upper surfaces of the side walls 8 of the holder housing 1, according to the purpose, in such a way that an additional securing of the bearing shell 18 is provided against axial wandering as well as against a turning around the axis of the shaft part 12 of the torsion bar spring 11.

According to the embodiment shown in FIGS. 8 to 11, it is additionally provided that the bearing shell 18 is fixed at the transverse wall 9 of the holder housing against rotation as well as against wandering in the longitudinal direction, in addition to the ears 19, or in general only by means of indentations or projections, particularly nipple-shaped projections 20, directed radially relative to its section axis. The nipple-shaped projection 20 of the bearing shell engages in a correspondingly constructed recess 21 of the transverse wall 9 of the holder housing 1 as can be seen particularly in FIG. 11.

While the invention has been illustrated and described as embodied in a spring support for a motor vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

1. A spring support for a motor vehicle door fastener in which a rigid door holding bar, which is hinged so as to be swivelable at one of a door arrangement part, a door and a door post and penetrates a holder housing which is rigidly fastened at another door arrangement part, is acted upon by means of a loading roller which is arranged so as to be freely rotatable on a free loading arm of a torsion bar spring arranged in and supported at the holder housing via a support arm, the spring support comprising an elongated recess 10 in the holder housing 1, in which recess the torsion bar spring 11 is received, the housing being folded from a sheet metal material blank; a bearing shell 18 of self-supporting and maintenance-free bearing material provided so as to support the torsion bar spring with respect to a shaft part 12 thereof, within the holder housing 1, the bearing shell 18 being held in a position inside the holder housing by a preselected pretensioning between the shaft part 12 and the support arm 13; and mechanically acting holding means 19 for additionally holding the bearing shell 18.

2. A spring support according to claim 1, wherein the bearing shell 18 has a substantially semicircular shaped cross section, the holding means 19 including ears 19 which are set off radially relative to the shell cross section so as to support the shell 18 at an outer surface of side walls 8 of the holder housing 1, the side walls being vertical relative to a plane of the torsion bar spring 11.

3. A spring support according to claim 1, wherein the bearing shell 18 has at least one radially outwardly directed projection 20 provided so that the shell 18 is fastenable inside the holder housing 1 so as to be secured against wandering in a circumferential direction as well as in a longitudinal direction.

4. A spring support according claim 3, wherein the radially outwardly directed projection 20 of the bearing shell 18 is formed by at least one nipple which is arranged in the center of the bearing shell with reference to its longitudinal extension and with reference to its cross-sectional profile.

5. A spring support according claim 3, wherein the bearing shell 18 is supported at the holder housing 1 by a plurality of the radial projections 20 which are directed radially relative to its cross-sectional section so as to secure the shell 18 against wandering.

6. A spring support according to claim 2, wherein the bearing shell 18 has a plastic coated self-supporting metal back, and the ears, which are set off radially relative to the shell cross section, are formed as tabs which are cut out in a jagged manner at acute angles relative to the longitudinal axis of the shell.

7. A spring support according to claim 6, wherein the metal back is coated with TEFLON.

8. A spring support according to claim 6, wherein the metal back is made of steel.

* * * * *